United States Patent [19]

Ueda et al.

[11] 4,192,486

[45] Mar. 11, 1980

[54] METHOD FOR CONTROLLING EXHAUST GASES IN OXYGEN BLOWN CONVERTER

[75] Inventors: Yuziro Ueda; Toru Yoshida, both of Sakai; Michiyasu Honda, Chihayaakasaku, all of Japan

[73] Assignee: Nippon Steel Corporation, Tokyo, Japan

[21] Appl. No.: 752,288

[22] Filed: Dec. 20, 1976

[30] Foreign Application Priority Data

Dec. 20, 1975 [JP] Japan ..... 50/152281

[51] Int. Cl.[2] ..... C22B 5/40

[52] U.S. Cl. ..... 266/44; 266/158

[58] Field of Search ..... 75/60; 122/7 A; 198/115 R; 266/44, 158

[56] References Cited

U.S. PATENT DOCUMENTS

| | | | |
|---|---|---|---|
| 3,227,141 | 1/1966 | Fahie | 122/7 A |
| 3,559,970 | 2/1971 | Hamabe et al. | 266/158 X |

FOREIGN PATENT DOCUMENTS

| | | | |
|---|---|---|---|
| 4714603 | of 1971 | Japan | 266/158 |
| 1187530 | of 1970 | United Kingdom | 266/158 |

*Primary Examiner*—Paul A. Bell

[57] ABSTRACT

A method for recovering unburnt exhaust gases in an oxygen converter, is described, which involves the control of an exhaust gas damper by means of a control signal obtained by signal-processing, in accordance with set functional formulae, an exhaust gas damper control signal obtained from the pressure differential between the converter throat pressure and atmospheric pressure, and an exhaust gas damper prediction control signal obtained by continuously detecting the quantities of oxygen fed and of secondary raw material charged, as well as the composition of the exhaust gases and the flow rate of exhaust gases. With this signal processing the quantity of furnace generated gases and the quantity of combustion exhaust gases at the converter throat are calculated and the degree of optimum aperture of the converter damper is controlled.

1 Claim, 12 Drawing Figures

METHOD FOR CONTROLLING EXHAUST GASES IN OXYGEN BLOWN CONVERTER

BACKGROUND OF THE INVENTION

This invention relates to a method for controlling exhaust gases in an oxygen blown converter.

In steel making in a converter using oxygen, as it is known, a method has been employed to recover combustible gases, such as carbon monoxide (CO) produced by blast refining, in the unburnt state for re-use as heat source.

The unburnt gases have been recovered by employment of a method in which the pressure differential between the throat pressure i.e. the pressure within the hood, and atmospheric pressure is detected, and an exhaust gas damper is automatically adjusted through an adjusting meter or regulator so that said pressure differential assumes a predetermined value. This method, however, unavoidably poses problems such as the so-called blow-out, in which the exhaust gases are emitted from the throat, and the so-called intake phenomenon, in which surplus air is sucked into the throat, due to a delay in detection or in transmission of signals due to rapid variations in the quantity of exhaust gases and a delay in response of the adjusting meter or the exhaust gas damper when the quantity or flow rate of the oxygen fed is changed, when a secondary material such as iron ore etc. is charged or completed to be charged, or when the quantity or feeding rate of a secondary raw material charge is changed in the case where the absolute quantity of the charge is changed. This results in a waste of unburnt exhaust gases and a considerable economic loss due to the wasteful burning of the exhaust gases resulting from intake of surplus air.

Thus, in the oxygen blown converter, a method has been employed in an effort to recover these combustible gases in an unburnt state, the method normally being called the method for recovering unburnt exhaust gases. For example, see the method of British Patent No. 1,187,530. In this method a controlling means therefor, generally called the throat pressure control, is used in which the pressure differential between the throat pressure, i.e., the pressure within the hood of the converter, and atmospheric pressure is detected and the operation of a damper is controlled so that said differential pressure assumes a predetermined level.

Incidentally, a method is employed to suck surplus air by suitably opening the dust collector damper in order to avoid the surging phenomenon of the draught fan for the exhaust gases despite the fact that the furnace generated gases are in very small amount at the early stage and at the last stage of the blast refining operation in the converter. This method, however, results in a wasteful burning of unburnt gases, leading to a considerable economic loss.

Further, the aforementioned throat pressure controlling method unavoidably involves delays in the detection or transmission of signals and delays in the response of the control means or of the damper drive means to a rapid change in converter reaction thereby inevitably producing the blow-out phenomenon, in which the combustible gases are emitted from the throat, or the excessive intake phenomenon, in which surplus air is sucked into the throat, often resulting in an economic loss such as dissipation or wasteful burning of the combustible gases. In addition the blow-out phenomenon is known to produce emission of red fumes, which is not desirable in terms of environmental health.

SUMMARY OF THE INVENTION

It is an object of the present invention to provide a method for recovering the unburnt exhaust gases without suffering from the blow-out or intake phenomena previously mentioned, and to provide a method which has great adaptability to varied operating and equipment conditions.

Another object of the invention is to provide a method for controlling exhaust gases without suffering from the blow-out or intake phenomena in the recovery of unburnt exhaust gases.

A further object of the invention is to enhance the recovery rate of exhaust gases and to reduce cost.

Briefly, according to one feature of the present invention, there is provided a method of controlling exhaust gases in an oxygen blown converter, characterized by predicting the quantity of furnace generated gases and varying the quantity of drawn exhaust gases.

DETAILED DESCRIPTION OF THE EMBODIMENTS

Figure 1:
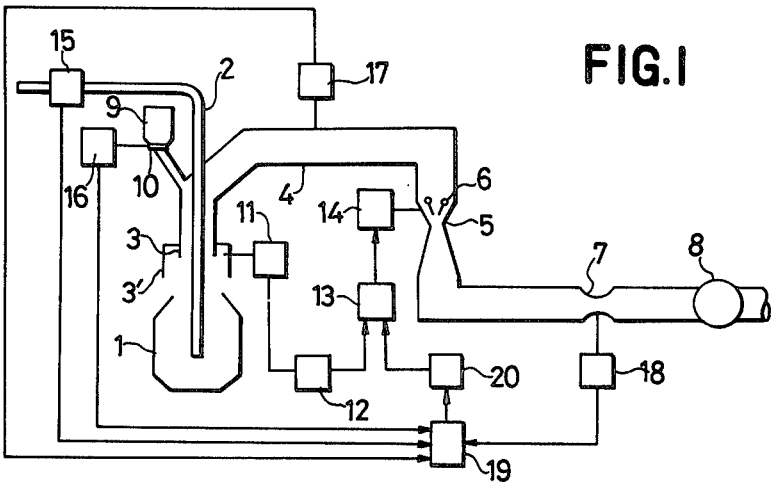
FIG. 1 is a schematic block diagram of an apparatus embodying the method of the present invention.

Referring now to FIG. 1, the reference numeral 1 designates a converter, the oxygen being introduced into the steel bath by means of the blast refining oxygen lance 2. The exhaust gases produced from converter 1 are passed through a collecting hood 3 provided with a vertically movable skirt 3' and an exhaust gas pipe 4 and are guided into a holder (not shown) or a smokestack (not shown) via a dust collector 5, an exhaust gas damper 6, a throat 7 provided with a flow detector, and a draught fan 8. The exhaust gas damper 6 may be of any convenient design as long as it is possible to control a quantity of flow. Secondary raw material, which may include fluxes and coolants is charged into the converter 1 from a secondary raw material hopper 9 through a charging feeder 10. The pressure differential between the pressure in the hood 3 (throat pressure) and atmospheric pressure is measured by a pressure differential oscillator or regulator 11, the signal thereof being supplied to a throat pressure controlling adjusting-meter or regulator 12. Adjusting meter 12 has the intended pressure differential value preset thereto and from this, the input signal from the aforesaid pressure differential oscillator 11 can be compared with the aforesaid pressure differential set value so that the resultant corrected signal is transmitted in the form of an exhaust gas damper control signal through a signal processor circuit 13 (later described) to a servomechanism 14 for operating the damper 6 in accordance with the conditions (later described) to thereby control the exhaust gas damper 6.

In this case, where a correction of the signal is not made by the signal processor circuit 13, the damper control based on the pre-set pressure difference can naturally be attained. In accordance with the present invention, in the case where a control based on a prediction (later described) is not desirable or is impossible to be used because of some operation conditions involved or because of troubles in the equipment, the aforesaid control based on the pre-set pressure differential, i.e., the feedback control may immediately be applied to the damper to thereby afford the advantages of control readiness and simplicity of maintenance. In addition, according to the invention, both the feedback control and the prediction controls may be carried out to thereby render possible a highly precise control.

A calculator 19 carries out the three operations noted below on the basis of inputs from an oxygen flow meter 15, a secondary raw material charge oscillator or regulator 16, an exhaust gas analyzer 17, and an exhaust gas flow meter 18:

(1) It calculates the quantity or flow rate of gases of formation formed by reaction with the oxygen supplied and the oxygen generated as a result of decomposition of charged secondary raw material.

(2) It determines the quantity or flow rate of cracked and reacted gases resulting from the decomposition of the secondary raw material.

(3) And it calculates the quantity or flow rate of combustion exhaust gases at the throat, burned and formed by air entered from the throat.

In the present invention, the abovementioned quantity or flow rate of gases of formation and quantity or flow rate of cracked and reacted gases are referred to as "the quantity of furnace generated gases".

In the case where the quantity of oxygen fed is varied as the operation progresses, that is, when the oxygen is begun to be fed and is increased or decreased in quantity, or when the secondary raw material is begun to be charged and is varied in quantity, is changed in kind or stopped to be charged, the quantity of furnace generated gases, i.e., gases produced within the hood abruptly varies. Thus, when the exhaust gas recovery control is delayed, as previously mentioned, blow-out or excessive intake phenomena occur. To prevent such occurences, the quantity or flow rate of furnace generated gases and the quantity or flow rate of combustion exhaust gases at the throat resulting from variation in the quantity or flow rate of oxygen fed and variation in the quantity of secondary raw material charged are calculated by calculator 19 by means of a prediction, the resulting data being supplied to a prediction control adjusting meter or regulator 20. This adjusting meter 20 provides then the degree of exhaust gas damper prediction control necessary to adjust the opening of the exhaust gas damper 6 to such a degree as not to produce the blow-out or excessive intake phenomena described above, and the control signal is delivered to the operating servomechanism 14 through the signal processor circuit 13 later described. Accordingly, the exhaust gas damper 6 will be opened or closed in response to an increase or decrease in the quantity of furnace generated gases, i.e., gases in the hood and the quantity of combustion exhaust gases at the throat before these gases increase or decrease. As a consequence, the exhaust gases are properly recovered, and the pressure differential between the throat pressure, i.e., the pressure in the hood and the atmospheric pressure is also properly maintained to minimize fluctuation thereof. This will be further discussed in detail with reference to the drawings.

Figure 2:
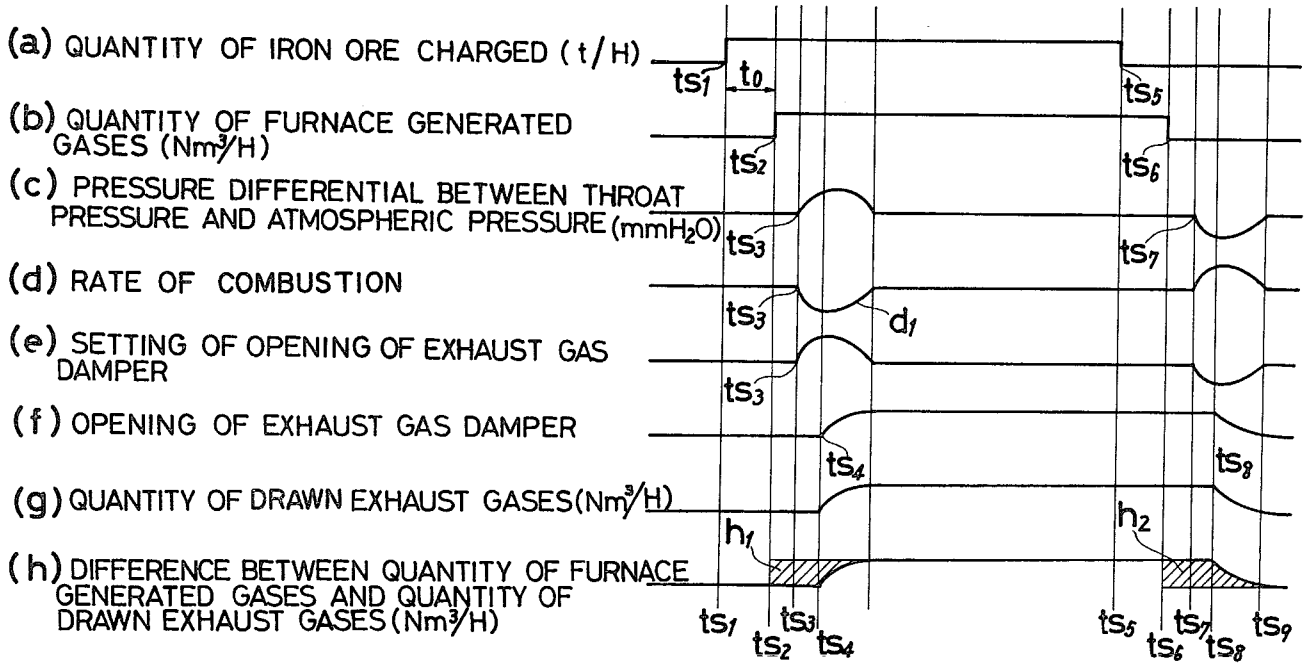
FIG. 2 schematically illustrates the control of the pressure differential.

In FIG. 2, (*a*) to (*h*), the abscissas represent the lapse of time, and the ordinate represents the quantity of variation with each item, thus showing the control based on the pressure differential between the throat pressure and the atmospheric pressure. In FIG. 2 (*a*), assuming that the iron ore as the secondary raw material has begun to be charged at time $t_{s1}$, the furnace generated gases begin to increase after the lapse of $t_o$ seconds, i.e., at time $t_{s2}$. (FIG. 2 (*b*) ) Then, the pressure differential between the throat pressure and the atmospheric pressure begins to increase at time $t_{s3}$, the pressure differential being detected by the pressure differential oscillator or regulator 11. When the pressure differential increases, air entered through the throat decreases or the furnace generated gases themselves begin to escape from the skirt 3', as a consequence of which the quantity of furnace generated gases burned within the throat will decrease. That is, the quantity of CO which burns with the air entered at the throat among the quantity of CO contained in the furnace generated gases increases. If the ratio of the quantity of CO in the furnace generated gases, i.e., gases produced in the hood, to the quantity of CO which burns at the throat is expressed in the combustion rate, the combustion rate decreases as in curve $d_1$ shown in FIG. 2 (*d*). Since opening of the exhaust gas damper 6 is set at the time when an increase in the aforesaid pressure differential has been detected as shown in FIG. 2 (*e*), the exhaust gas damper 6 will not be opened until time $t_{s4}$ is reached as shown in FIG. 2 (*f*). The quantity of exhaust gases to be sucked thus begins to increase at time $t_{s4}$ as shown in FIG. 2 (*g*). As previously mentioned, however, the furnace generated gases increase at time $t_{s2}$, and hence, the differential between the quantity or flow rate of suction exhaust gases and the quantity or flow rate of furnace generated gases, i.e., the quantity of exhaust gases corresponding to the cross-hatched area $h_1$ in FIG. 2 (*h*) is blown out of the throat and is dissipated outside the exhaust gas recovery system. Further, after the secondary raw materal has been charged, the quantity of furnace generated gases is actually decreased at time $t_{s6}$ but there is a delay in response so that the exhaust gas damper 6 remains open until time $t_{s9}$ is reached thereby allowing air corresponding in quantity to the cross-hatched area $h_2$ to enter through the throat. The exhaust gases are burned by the thus entered air to decrease the amount of thermal calories of the recovered exhaust gases and to increase the temperature of the exhaust gases simultaneously therewith, and as a result, extra energy is required to cool the exhaust gases and the service life of the machinery may be shortened.

Figure 3:
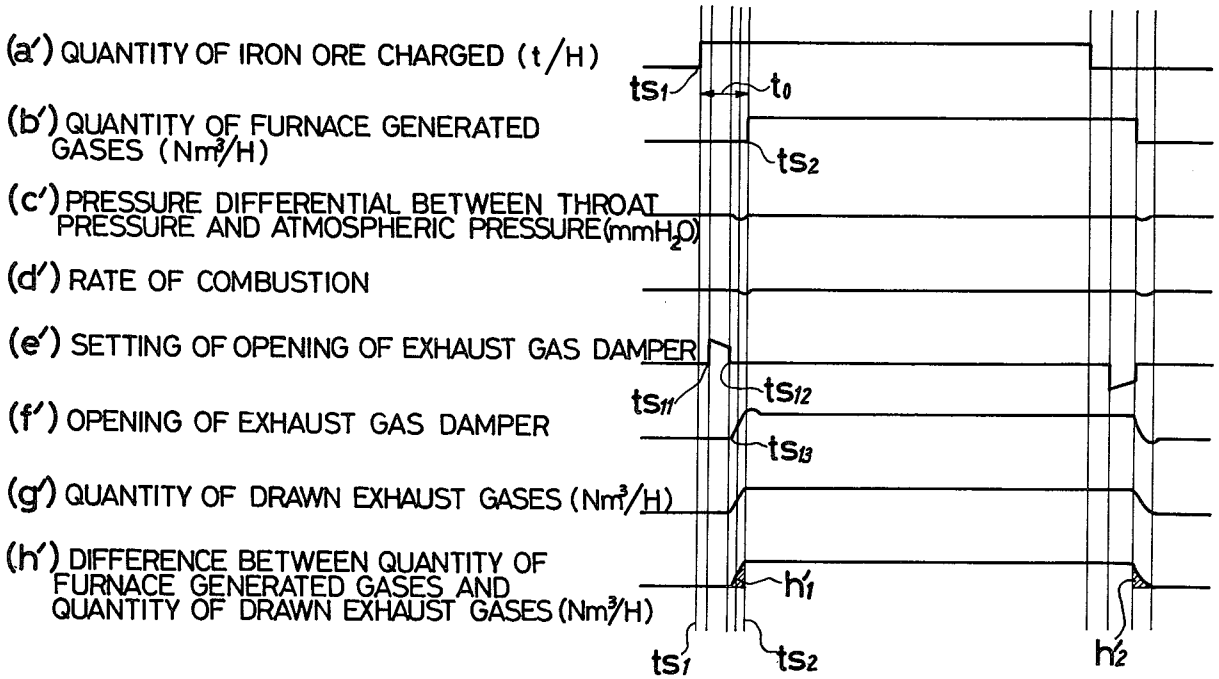
FIG. 3 schematically illustrates the prediction control in accordance with the present invention.

In order to overcome the response delay as noted above, the present invention provides a prediction control as shown in FIG. 3, (*a'*) to (*h'*). In FIG. 3 (*a'*), at ore charging time $t_{s1}$, an ore charge starting signal is received from the secondary raw material charge oscillator or regulator 16, and immediately the opening of the exhaust gas damper 6 is set through the calculator 19 and the prediction control adjusting meter or regulator 20 at time between $t_{s11}$ and $t_{s12}$, the exhaust gas damper 6 being opened at time $t_{s13}$. Since time $t_{s13}$ is actually earlier than time $t_{s2}$ at which the furnace generated gases, i.e. gases generated in the hood begin to increase, the difference between the quantity or flow rate of the furnace generated gases and the quantity or flow rate of the suction exhaust gases produced will suck a small amount of air corresponding to the cross-hatched area h'1 as shown in FIG. 3 (*h'*). However, this is merely one example. Practically, the increase in the quantity or flow rate of furnace generated gases and the adjustment in the opening of the exhaust gas damper 6 may be so arranged as to minimize the above-mentioned air suction to a negligible degree.

It will be noted in FIG. 3 that the difference between the quantity or flow rate of furnace generated gases and the quantity or flow rate of suction exhaust gases after the secondary raw material has been charged, i.e., the quantity corresponding to the cross-hatched portion *h'*2 in FIG. 3 (*h'*) is the residual quantity or flow rate of suction air wich has not been burned. It is obvious that in the recovery of such exhaust gases, a control involving neither blow-out nor excessive intake phenomena is preferable. However, the control has a tendency to be one-sided and biased to either mode even if little depending upon equipment condition. In this case, it is preferable to adjust the control system to favor the intake side in terms of both operating environment and utilization effect of the exhaust gases, although this is in no way critically restrictive. While a variation in the quantity of raw material being charged has been described with particular emphasis on iron ore, it is to be understood that also with other ores a similar procedure may be employed to achieve similar effects.

Next, a method for calculating the quantity or flow rate of combustion exhaust gases at the throat to be sucked will be described in detail. Percent concentrations of exhaust gases analyzed as CO, $CO_2$, $H_2$ and $N_2$ and obtained from the exhaust gas analyzer 17 are expressd by XCO, $XCO_2$, $XO_2$, $XH_2$ and $XN_2$ respectively. With respect to $XN_2$, since the gases generated within the converter comprise CO, $CO_2$and $H_2$, it may be assumed that most of the $N_2$ within the exhaust gases originates from air entered through the throat. It may also be assumed that the greater part of the $O_2$ contained in the air entered through the throat burns with CO within the furnace generated gases and that only a small amount thereof is detected as $XO_2'$ within the exhaust gases. Accordingly, the percent concentration $Xo_2'$ of the $O_2$ contained in the air entered through the throat can be calculated by equation (1) below from the concentration of the quantity of $N_2$ contained in the air entered through the throat, i.e.

$$XO_2' = (21/79)\ XN_2 \tag{1}$$

From this, the percent concentration $XO_2''$ of the quantity of $O_2$ in the gases combusted in the furnace within the collecting hood 3 may be readily obtained by equation (2) below from the quantity of $O_2$ not obtained from combustion, i.e., the concentration $XO_2$ of $O_2$ within the exhaust gases, $$XO_2'' = XO_2' - XO_2 \tag{2}$$

The CO within the furnace generated gases is oxidized to $CO_2$ as indicated by equation (3) below by the $O_2$ during combustion, $$2CO + O_2\ 2CO_2 \tag{3}$$

Thus, the CO produced in the converter is partly oxidized by the $O_2$ within the air entered through the throat, and as a consequence, the CO concentration decreases as compared to the furnace generated gases while the $CO_2$ concentration increases. From the foregoing, the percent concentrations (XCO' and $XCO_2'$) of CO and $CO_2$, respectively, in the combustion exhaust gases produced within the converter's throat may be obtained by equations (4) and (5), respectively, $$XCO' = XCO + 2.XO_2'' \tag{4}$$

$$XCO_2' = XCO_2 - 2.XO_2'' \tag{5}$$

From this, a ratio of the air entered through the throat to the quantity of burning CO, among the quantity of CO produced in the converter, i.e., the combustion rate λ may be obtained by equation (6) below, $$\lambda = (XCO' - XCO)/XCO' \tag{6}$$

Further, the relation of variation in volume when the furnace generated gases turn into combustion exhaust gases at the throat may be obtained by equation (7) below, from which the quantity or flow rate of combustion exhaust gases to be sucked may be calculated.

$$\frac{\text{Quantity of combustion exhaust gases}}{\text{Quantity of furnace generated gases}} = \frac{100}{(XCO' + XCO_2'' + XH_2)} \tag{7}$$

Next, the quantity of furnace generated gases, i.e., gases generated in the converter may be calculated as follows: If the total quantity of oxygen supplied to the converter 1 reacts with carbon within the steel bath as indicated by equation (8) below, the volume in quantity of gases of formation after reaction in a standard condition is twice as much as the volume of the total quantity of oxygen supplied.

$$2C + O_2\ 2CO \tag{8}$$

However, since a part of the oxygen is also reacted as indicated by equation (9) below, an increase in volume of gases of formation after the reaction with respect to the total quantity of supplied oxygen is reduced by a given produced amount of $CO_2$, $$2CO + O_2\ 2CO_2 \tag{9}$$

Assuming now that the percent ratios of CO and $CO_2$ produced in the converter to the quantity of combustion exhaust gases at the throat are XCO' and $XCO_2'$, respectively, as previously mentioned and the ratio of the quantity of $CO_2$ produced in the converter to the quantities of the furnace generated CO and $CO_2$ is γo/o, may be obtained by equation (10) below, $$\gamma = \frac{XCO_2'}{XCO' + XCO_2''} \times 100 \quad (10)$$

From this, the ratio of the quantity or flow rate of gases of formation after reaction to the total quantity of supplied oxygen may be obtained by equation (11) below, $$\frac{\text{Quantity of gases produced within converter after reaction}}{\text{Total quantity of supplied oxygen within converter}} = (2 - \frac{\gamma}{100}) \quad (11)$$

Let $Fo_2{}^3$ be the quantity (in $Nm^3/Hr$) of oxygen fed obtained from the oxygen flow meter 15; $W_1T/Hr$ the charged quantity of $O_2$-producing secondary raw material obtained from the secondary raw material charge oscillator 16; $\alpha_1 Nm^3/T$ the coefficient of producing $O_2$; $W_2T/Hr$ the charged quantity of secondary raw material which produces cracked reaction gases; and $\alpha_2 Nm^3/T$ the coefficient of producing gases thereof. Then, the quantity F (in $Nm^3/Hr$) of gases of formation produced resulting from reaction with oxygen within the converter, the cracked reaction gases produced resulting from cracking of the secondary raw material, $F_2$ (in $Nm^3/Hr$), the quantity $F_3$ (in $Nm^3/Hr$) of furnace generated gases produced in the converter, which $F_3$ is the sum of $F_1$ 3 and $F_2$ 3, are given by equations (12), (13) and (14), respectively, $$F_1 = (2 - \frac{\gamma}{100})(Fo_2 + 1 \cdot W_1) \quad (12)$$

$$F_2 = \alpha_2 . W_2 \quad (13)$$

$$F_3 = F_1 + F_2 \quad (14)$$

The coefficients $\alpha_1$ and $\alpha_2$ can easily be obtained from the constituents of the respective secondary raw material. Generally, however, in iron ores, $\alpha_1 = 150$ to 250 $Nm^3/T$, and in raw dolomite, $\alpha_2 = 150$ to 250 $ONm^3/T$.

Accordingly, the quantity or flow rate of combustion exhaust gases $F_4$ resulting from the combustion at the throat may be obtained easily by equation (7') below rather than equation (7) described above, $$F_4 = \frac{100}{XCO' + XCO_2' + XH_2} \cdot F_3 \quad (7')$$

Figure 4:
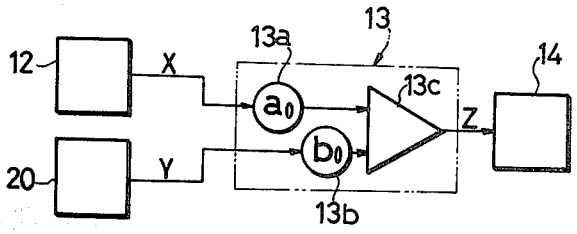
FIG. 4 schematically illustrates the signal processing in a signal processing circuit in accordance with the present invention.
Figure 5:
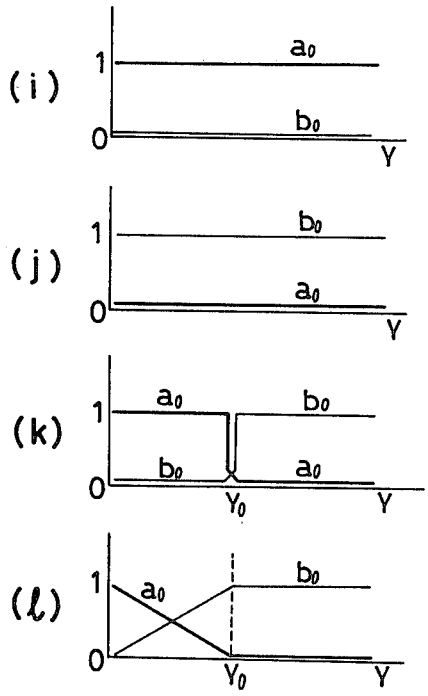
FIG. 5, (i) to (l), schematically illustrates the coefficient of coupling.

Signal processing of the exhaust gas damper control signal based on the pressure differential between the throat pressure and the atmospheric pressure, and of the exhaust gas damper prediction control signal based on change in the quantity of oxygen fed and in the quantity of secondary material charged in accordance with the present invention will now be described in detail with reference to FIGS. 4 and 5. In FIG. 4, the control signal X of the exhaust gas damper 6 from the throat pressure controlling adjusting-meter 12 and the control signal Y from the prediction control adjusting meter 20 are supplied to a conventional type of signal processor circuit 13. As a signal processor circuit 13, FIG. 4 e.g. shows a combination of two conventional potentiometers 13*a*, 13*b* and a conventional adder 13*c* for carrying out the processing as shown in FIG. 5 (*i*) and (*j*). In the signal processor circuit 13, the process, for example, may be carried out based on equation (15) below to provide a control signal Z.

$$Z = a_o X + b_o Y \quad (15)$$

where, $a_o$ and $b_o$ are the coefficients of coupling in 13*a* and 13*b*, respectively. In this case, the control based on the pressure differential between the throat pressure and the atmospheric pressure may be employed only by setting the coefficients of coupling to:

$$a_o = 1 \text{ and } b_o = 0$$

as shown in FIG. 5 (*i*), depending on equipment conditions, such as troubles in apparatus, or on operating conditions, or on a method relying on the quantity of the exhaust gas damper, the prediction control may be employed by setting the coefficients of coupling to:

$$a_o = 0 \text{ and } b_o = 1$$

as shown in FIG. 5 (*j*).

Further, in the case where the control signal is in excess of a predetermined control signal value $Y_o$ as shown in FIG. 5 (*k*), linear coupling may be employed so as to have the coefficients of coupling as shown below at that time, namely:

$$a_o = 0 \text{ and } b_o = 1$$

That is, the prediction control at the time of changing the quantity or flow rate of oxygen fed and/or the quantity of secondary raw material charged, may easily be accomplished by selecting the set control signal value $Y_o$ so as to assume a suitable value. To achieve control with high accuracy, the coefficient of coupling $a_o$ may gradually be decreased and conversely the coefficient of coupling $b_o$ may gradually be increased until the set control signal value $Y_o$ is reached, as shown in FIG. 5 (*l*), then the coefficients of coupling are $$a_o = 0 \text{ and } b_o = 1$$

at the set control signal value $Y_o$.

It will be noted in the present invention that higher linear couplings or couplings with other functions may also be employed by using Z as a function of X and Y—, Z=f(X,Y). In the present invention, accomplishment of control in accordance with the signal process noted above is referred to as the control of exhaust gas damper in accordance with the control signal obtained from signal processing in accordance with the set functional equation. The abovementioned signal processor circuit 13 comprises a combination of known control elements so that functional analysis in compliance with the intended purpose may be obtained. For example, the processes as shown in FIG. 5 (*i*) and (*j*) can be carried out by the signal processor circuit 13 of the type shown in FIG. 4.

The processes as shown in FIG. 5 (*k*) and (*l*) can be accomplished by the signal processor circuit of a conventional type including a comparator, a functional generator etc.

Figure 6:
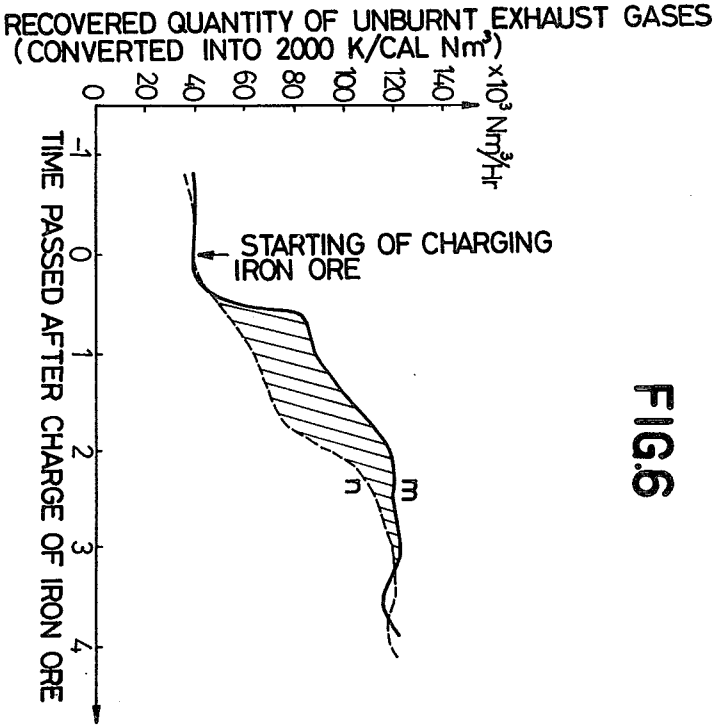
FIGS. 6 and 7 illustrate a comparison of the quantity of recovered unburnt gases according to the present invention and to prior art methods, in connection with a 170-t converter.
Figure 7:
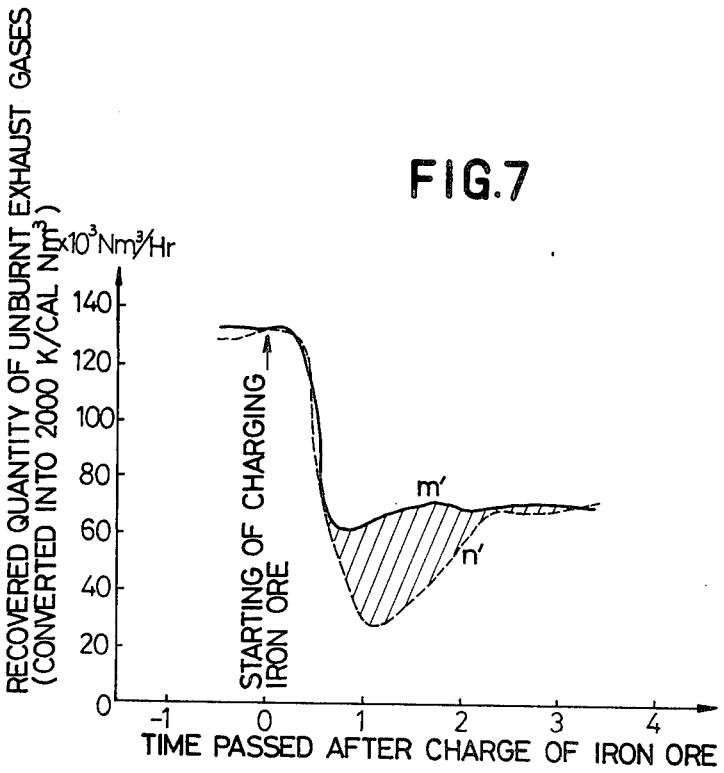

An embodiment of the invention in connection with a 170-t converter is shown in FIGS. 6 and 7. FIG. 6 is a graphic representation, in which variations in the recovered quantity of unburnt exhaust gases, which has been converted into a quantity of gases with a standard calorific power (2000 $Kcal/Nm^3$) is illustrated relative to time (minutes) passed after commencement of charging of the iron ore, the solid line (m) representing the example of the present invention, the dotted line (n) the example of the prior art method, and the cross-hatched area being the amount by which the recovered quantity of unburnt gases is enhanced or the gas emission from the throat is decreased, i.e. An enhancement of 500Nm$^3$ in this example. FIG. 7 is graphic representation, in which variations in the recovered quantity of unburnt gases converted into calorific power at the time of completion of charging of the iron ore is illustrated relative to time (minutes) passed after completion of charging, the solid line (m') representing the example of the present invention, the dotted line (n') the example of the prior art method, and the cross-hatched area being the amount by which the recovered quantity of unburnt gases is enhanced or the entry of the surplus air from the throat is restrained, i.e., an enhancement of 400Nm$^3$ in this example.

Figure 8:
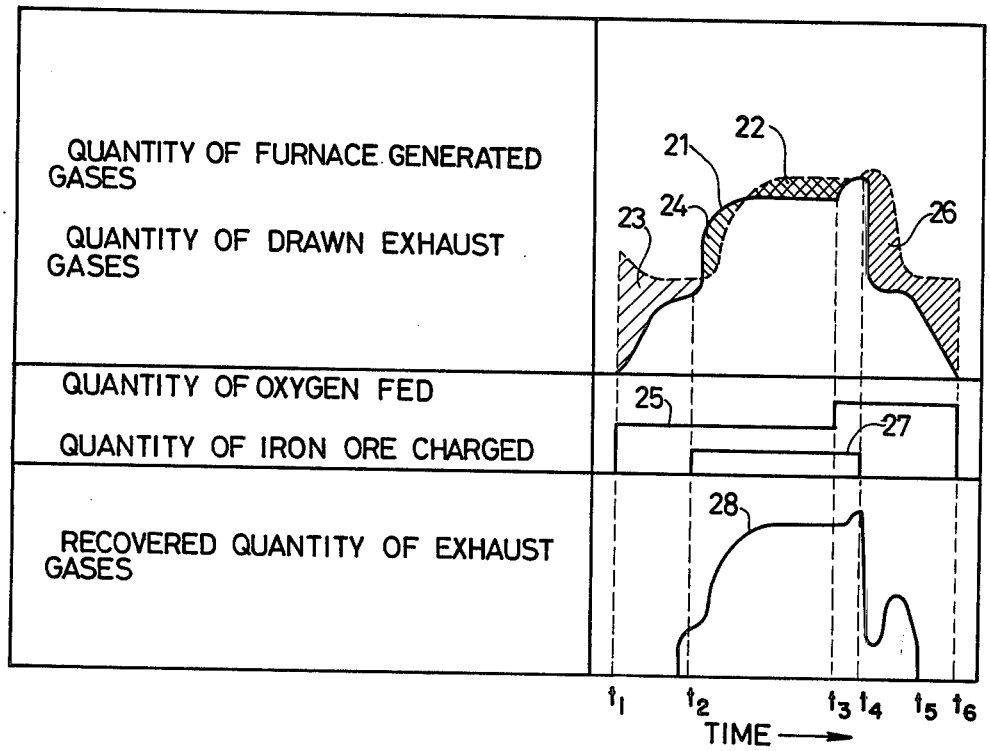
FIG. 8 illustrates the variation with time in the control of the throat pressure.

FIG. 8 is a schematic explanatory view of the exhaust gas recovery in the known throat pressure control, the abscissa representing time while the ordinate represents the quantity of furnace generated gases, the quantity of exhaust gas flow, the quantity of oxygen fed, the quantity of iron ore charged, and the recovered quantity of exhaust gases, variations thereof with time being illustrated in the form of graphs. At time $t_1$, blast refining begins, and the quantity of furnace generated gases varies with a lapse of time as shown by the solid line 21. Incidentally, since openings of the dust collector damper and draught fan damper are set to be greater than the quantity of furnace generated gases in fear of surging of the draught fan as previously mentioned, the suction quantity of the exhaust gases varies as shown by the dotted line 22. That is, the cross-hatched area 23 means the intake of surplus air from the throat portion, and hence, at an early stage in blast refining as indicated by time $t_1$ and time $t_2$, combustible gases or CO gases being wastefully burned within a flue and failing to recover gases, and dust contained within the furnace generated gases, by combustion, are formed into fine particles decreasing dust collecting efficiency. Gas recovering normally begins when the amount of CO in the exhaust gases reaches approximately 40%, which is determined from an economic utilization of exhaust gases. If the intake of the surplus air could be reduced, the rate of gas recovery during time $t_1$ to $t_2$ would be enhanced. Next, the furnace generated gases abruptly increase in volume as the reaction in the converter violently takes place at time $t_2$. However, in the throat pressure control method, the quantity of drawn gases cannot follow an increase in quantity of furnace generated gases due to a response delay of the control system, and for this reason, in the cross-hatched area 24, the furnace generated gases are blown out of the throat to wastefully lose CO gases leading to an adverse effect also in terms or environmental health.

Next, at a middle stage of the blast refining, the quantity of furnace generated gases will be stabilized and the quantity of drawn exhaust gases will also be stabilized accordingly. However, in a final stage of blast refining, when the operation is conducted so as to increase the quantity of oxygen fed at time $t_3$ as shown by the solid line 25 for the purpose of approaching the desired quantity of carbon in the steel, the quantity of furnace generated gases may increase for a while but will abruptly decrease as the quantity of carbon in the steel decreases. Also, at this time, the quantity of drawn exhaust gases cannot follow the variations in quantity of furnace generated gases due to the delay of the control system to produce the excessive intake of surplus air from the throat portion as shown by the cross-hatched area 26 leading to a wasteful combustion and thus giving rise to a problem very similar to that produced in the above-mentioned cross-hatched area 23.

In FIG. 8, the solid line 27 indicates the charging of secondary raw material or the like representative of the quantity of iron ore charged, and the solid line 28 indicates the recovered quantity of gases of standard calorific power.

The present invention may provide a control method without suffering from the difficulties noted above with respect to prior art exhaust gas controls, and principally comprises predicting the quantity of furnace generated gases as previously mentioned, and varying the quantity of drawn exhaust gases. When the quantity of furnace generated gases is expected to be increased or decreased, opening of the dust collector damper is effected beforehand so that the quantity of drawn exhaust gases may synchronously be increased or decreased in response to an increase or decrease in the quantity of furnace generated gases as previously mentioned.

The method of the present invention will now be described by way of an illustrative embodiment.

Figure 9:
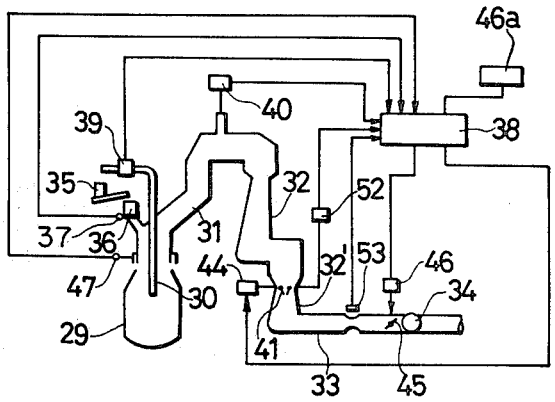
FIG. 9 is a schematic block diagram of an apparatus for recovering unburnt exhaust gases in a converter.

In FIG. 9, the reference numeral 29 designates a converter, 30 an oxygen lance, 31 and 33 exhaust ducts, 32 and 32' dust collectors, and 34 a draught fan. In blast refining, the secondary raw material is charged into the converter 29 through a charging chute 36 from the secondary raw material charging device 35, the charged quantity being signal-supplied from a secondary raw material charge oscillator 37 to an operation control device 38. The quantity of oxygen fed is signal-supplied to the operation control device 38 from an oxygen flow meter 39 and the composition of the exhaust gases signal-supplied thereto from an exhaust gas analyzer 40. Opening of a dust collector damper 41 (hereinafter referred to as a DC damper) disposed e.g. in the dust collector 32' is similarly signal-supplied to the operation control device 38 from an opening oscillator 52 and the quantity of exhaust gas flow is signal-supplied thereto from a flow meter 53. DC damper 41 is operated by the control device 38 through a DC damper control device 44 and a draught fan damper 45 (hereinafter referred to as a SD damper) operated thereby through an SD damper control device 46. The information input device indicated at *46a* is provided to supply the various information required to predict the quantity of furnace generated gases, such as for example the quantity of hot metal, the quantity of molten metal, the quantity of scrap, the temperature of the hot metal, the content of Si, the quantity of lime, etc. to the operation control device 38. A throat pressure oscillator 47 is provided to similarly supply the throat pressure signal to the operation control device 38.

The method of the present invention may be carried out through the devices just mentioned, and the quantity of furnace generated gases can be predicted in the following manner:

The percent concentrations of CO, $CO_2$, $O_2$, $H_2$ and $N_2$ within the exhaust gases obtained from the exhaust gas analyzer 40 are expressed by XCO, $XCO_2$, $XO_2$, $XH_2$, $XN_2$. The analyzed values of the exhaust gases are indicated by the concentrations XCO to $XN_2$ the exhaust gas flow value (F) obtained by the exhaust gas flow meter 53, the quantity of furnace generated gases, and the concentration of gases thereof may be given as follows. Utilizing the equations $$XO_2' = 21/79 \cdot XN_2 \quad (1)$$

$$XO_2'' = XO_2' - XO_2 \quad (2)$$

$$XCO' = XCO + 2 \cdot XO_2'' \quad (4)$$

$$XCO_2' = XCO_2 - 2 \cdot XO_2'' \quad (5)$$

the quantity F' of furnace generated gases is given by equation (16) below, $$F' = F \cdot (XCO' + XCO_2') \quad (16)$$

The above described equations 1, 2, 4, 5 and 16 are not concerned with $H_2$ gas, the $H_2$ gas being handled similarly to Co gas.

Figure 10:
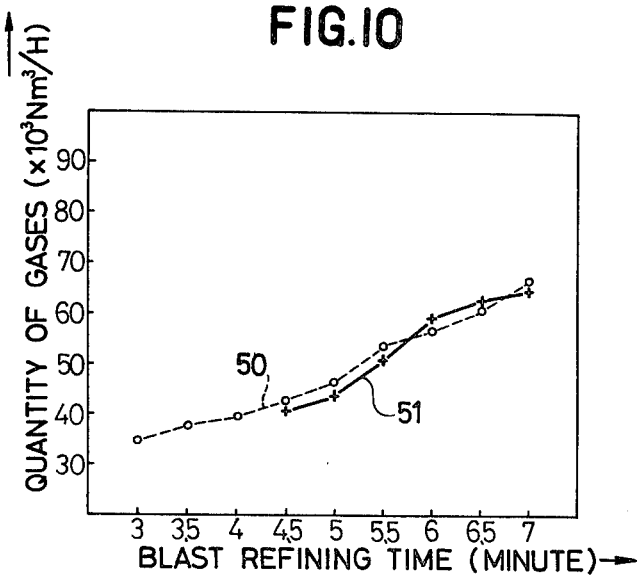
FIG. 10 is a graph explaining the prediction of the quantity of furnace generated gases.

Next, the prediction of the quantity F' of furnace generated gases will be described. Let F'n be the value at time tn of the quantity F' of furnace generated gases obtained by the equation (16). It is now assumed that the present time instant is expressed by n =0, that time prior thereto is expressed by n = −1, −2 . . . , and that time subsequent thereto is expressed by n = +1, +2 . . . The n can suitably be determined. FIG. 10 illustrates one embodiment which predicts the quantity $F'_{+1}$ of furnace generated gases 30 seconds after the quantities $F'_{-2}$, $F'_{-1}$, $F'_O$ of furnace generated gases at three times at intervals of 30 seconds, n = −2, −1, and 0 in an early stage of the decarburization reaction. In FIG. 10, the dots of curve 50 designate the quantity F' of furnace generated gases at 30 seconds intervals, and the crosses of curve 51 designate the predicted value $F'_{+1}$ of the quantity of furnace generated gases obtained by linear components taken from three individual rows, $F'_{-2}$, $F'_{-1}$, and $F'_O$. It is obvious from the figure that this prediction method is very accurate. It will however be noted that in order to further enhance accuracy, curve components such as a quadratic equation may also be employed or, prediction at other selected suitable times may be accomplished.

That is, if the quantity F' of furnace generated gases is obtained, the quantity $F_{ex}$ of drawn exhaust gases can easily be obtained by the equation, $$F_{ex} = K \cdot F.' \quad (17)$$

where K is the coefficient used to obtain the quantity of exhaust gases drawn by the draught fan from the quantity of furnace generated gases, good results being obtained by setting such coefficient K equal to 1.2 according to experience of the present inventor. However, the coefficient K varies with the characteristics of the equipment, so that the range thereof may be assumed to range from 1.0 to 1.4.

Figure 11:
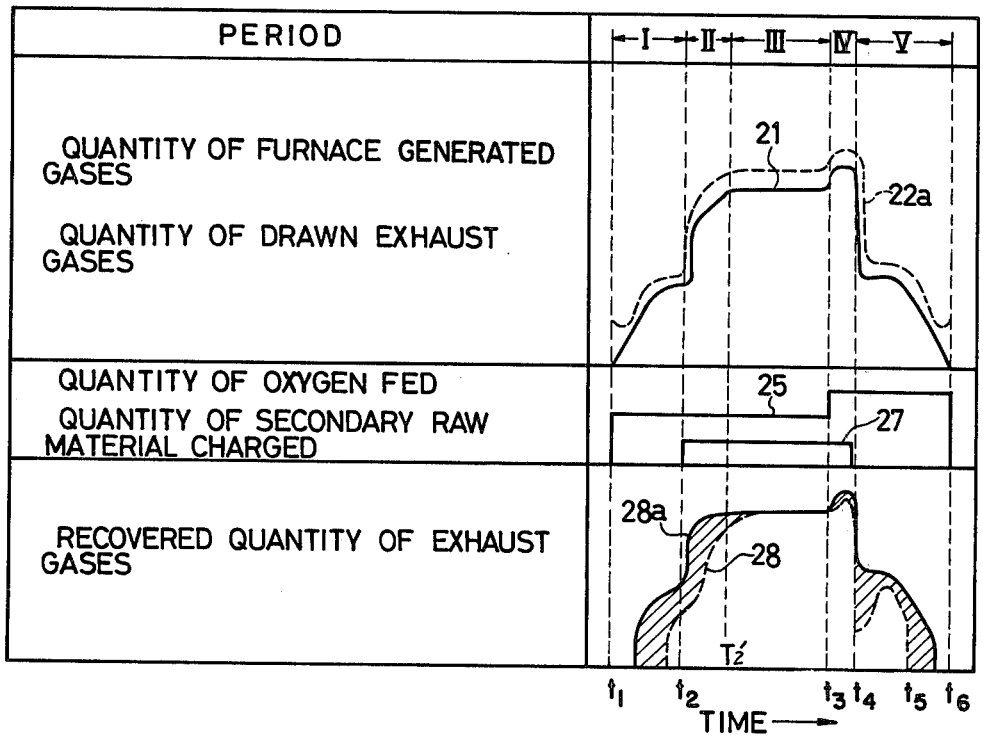
FIG. 11 illustrates the variation with time of gas recovery in accordance with the controlling method of the invention.

The embodiment of the control method in accordance with the present invention will now be described with reference to the graphs shown in FIGS. 11 and 12. In FIG. 11, the ordinate represents the quantity of furnace generated gases 21, the quantity of drawn exhaust gases 22 *a* in accordance with the present method, the quantity of oxygen fed 25, the quantity of other secondary raw material charged 27 (including an oxidation coolant), the recovered quantity of gases 28 (in standard calorific power) not in accordance with the present method, and the recovered quantity of gases 28*a* (in standard calorific power) in accordance with the present method, whereas the abscissa represents time intervals $t_1$–$t_6$, illustrating variation thereof with time.

It is assumed that the step from the beginning of blast refining at time $t_1$ to charging of other secondary raw material (including the oxidation coolant) at time $t_2$, i.e., from the desiliconizing reaction to the early decarburization reaction is period I; the step from a rapid increase in the quantity of furnace generated gases to a subsequent mode of stabilization, i.e., the step of rapid increase in the quantity of gases resulting from the charging of the oxidation coolant and other secondary raw material from time $t_2$ to time $t_2'$ is period II; the step of a further mode of stabilization of the quantity of furnace generated gases, i.e., the step from time $t_2'$ to time $t_3$ is period III; the step of increasing the quantity of oxygen fed to temporarily increase the quantity of furnace generated gases, i.e., the step from time $t_3$ to $t_4$ is period IV; and the step of the last stage of blast refining until oxygen feeding is stopped, i.e., from time $t_4$ to time $t_6$ is period V.

During period I, the quantity of furnace generated gases is predicted but the gases are not produced in great quantity during this period so that the quantity of drawn exhaust gases may be determined in consideration of surging of the draught fan.

Figure 12:
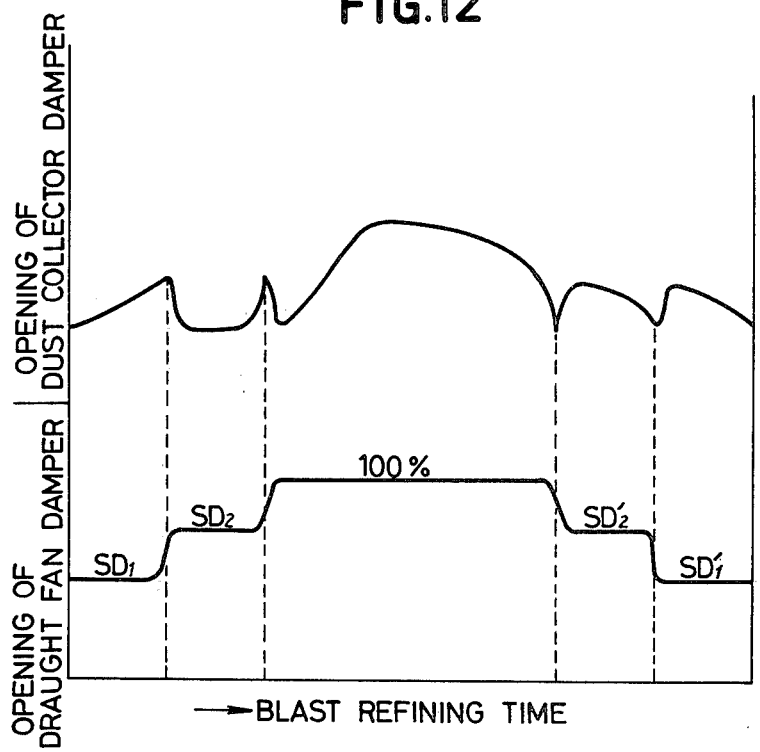
FIG. 12 is a graphic illustration explaining the operation of a draught fan damper and a dust collector damper.

FIG. 12 illustrates the operation of opening of the draught fan damper and the dust collector damper. That is, at the time of starting the blast refining operation the opening of the draught fan damper is set at $SD_1$, and as the quantity of furnace generated gases increases, the opening of the dust collector damper is widened. When said opening has reached a given value, the opening of the draught fan damper is reset at $SD_2$ ($SD_2$, $SD_1$) and at the same time, the opening of the dust collector damper is narrowed in accordance with the required quantity of exhaust gases. This operation is repeated one or several times until the opening of the draught fan damper is 100 then the dust collector damper is independently controlled. During the period in which the furnace generated gases are decreased in the last stage of blast refining, a damper control operation reverse to that mentioned above is carried out.

Next, a method for the control of time relative to the blast refining will be described. In period I, the draught fan damper is restricted to reduce the intake amount, whereby increasing the unburnt portion in the exhaust gases. That is, the quantity of furnace generated gases is predicted as previously mentioned, and the resultant value and the pre-obtained formulas between the draught fan damper, the dust collector damper and the flow rate of the exhaust gases are used to obtain the opening of the damper to thereby set the openings of the draught fan damper and the dust collector damper beforehand.

In period II, the quantity of furnace generated gases is rapidly varied so that future variations in quantity of furnace generated gases resulting from the charging of the secondary raw material is predicted and meanwhile, the dust collector damper is actuated beforehand so as to obtain the quantity of drawn exhaust gases corresponding thereto. That is, the control is done so as not to produce a delay in the actual variation, and in this period II, the draught fan damper is placed in the fully open state so as to produce no harm in the drawing of the exhaust gases. Then, in period III, the quantity of furnace generated gases is rich and stabilized so that a direct control of the throat pressure can be made. Principally, the dust collector damper is independently controlled.

Next, in period IV, when the quantity of oxygen fed is increased, further variations in the quantity of furnace generated gases resulting from an increase in the quantity of oxygen fed may be predicted with high accuracy, and the dust collector damper should be actuated beforehand in accordance with the prediction attained. That is, in period IV, employment of a control principally based on the throat pressure control is not desirable since the blow-out phenomenon occurs. In period V, the quantity of furnace generated gases is rapidly reduced, and hence, the same consideration as for period I is rendered necessary. That is, the control is made taking into consideration the surging of the draught fan damper and a simultaneous control of the dust collector damper and of the draught fan damper is made to vary the quantity of the drawn exhaust gases.

In accordance with the abovementioned control, the quantity of drawn exhaust gases 22*a* comes very close to the quantity of furnace generated gases 21 to produce no time lag and to minimize the aforementioned blow-out or intake phenomena. It has been proved from a comparison of the results between the present invention and the prior art with respect to the recovered quantity of gases of standard calorific power (FIG. 11) that the recovered quantity of gases 28*a* in accordance with the present invention is materially greater in periods I, II, IV, and V, such increase in the recovered quantity reaching 10 $Nm^3$/T.S. in one example, as compared to the known constant throat pressure control. In addition, according to the invention, electric power savings have also been achieved, as for example, 0.3 KWH/T.S.

What is claimed is:

1. A method of controlling exhaust gases in an oxygen blown converter for recovering the exhaust gases in an unburnt state, comprising the steps of:

(a) providing means including a hood for recovering gases generated within the said converter in the unburnt state;

(b) providing a duct means communicating with the said hood for sucking the said gases;

(c) providing at least one damper means mounted in the said duct for adjusting the flow rate of the said gases;

(d) providing means for cleaning the said gases sucked through the said duct and for eliminating dust contained in the said gases;

(e) providing means for preventing air from penetrating into the said converter between the said hood and a furnace throat of the said converter to enhance the efficiency in the recovery of the said gases;

(f) providing a charge information input means for supplying a charge information signal consisting of the quantity of hot metal, the quantity of scrap metal, the temperarture of the hot metal, and the silicon content;

(g) detecting the flow rate of oxygen supplied to the converter to obtain a first flow rate signal;

(h) detecting the amount of secondary raw material charged to the converter to obtain a secondary raw material charge signal;

(i) analyzing the composition of the gases passing through the said duct to obtain an analysis signal;

(j) detecting the flow rate of the gases passing through the said duct to obtain a second flow rate signal;

(k) combining the said charge information signal, the said secondary raw material charge signal, the said analysis signal, the said first flow rate signal, and the said second flow rate signal and computing by calculation the amount of the generated gases after reaction, the amount of gases resulting from the decomposition reaction and the amount of combustion gases at the furnace throat:

(l) providing means for calculating a prediction control variable by using the output from step (k);

(m) detecting the pressure difference between the gas pressure within the said hood and atmospheric pressure to obtain a pressure differential signal;

(n) providing a pressure controlling adjusting means for receiving the said pressure differential signal and comparing it with a predetermined reference value to obtain an exhaust damper control signal for reducing the difference between the said pressure differential signal and the said reference value; and (o) determining the optimum control signal to adjust the degree of opening of the said damper by combining said damper control signal from said pressure controlling adjusting means and the output signal from the said prediction control variable calculating means in a signal processing circuit, wherein each of said output signals is multiplied by a respective coupling coefficient, said coefficient being responsive to equipment operational conditions, and transmitting the said optimum control signal from the said signal processing circuit to a servo mechanism for operating the said damper to minimize blow out and intake phenomena at the furnace throat of the said converter.

* * * * *